US011441317B1

(12) United States Patent
Gory

(10) Patent No.: US 11,441,317 B1
(45) Date of Patent: Sep. 13, 2022

(54) APPARATUS FOR INSTALLATION OF SELF-ADHERING ROOFING MATERIAL

(71) Applicant: James Gory, Sorrento, FL (US)

(72) Inventor: James Gory, Sorrento, FL (US)

( * ) Notice: Subject to any disclaimer, the term of this patent is extended or adjusted under 35 U.S.C. 154(b) by 0 days.

(21) Appl. No.: 16/855,781

(22) Filed: Apr. 22, 2020

Related U.S. Application Data

(60) Provisional application No. 62/836,764, filed on Apr. 22, 2019.

(51) Int. Cl.
*E04D 15/06* (2006.01)
*E04D 5/14* (2006.01)
*E04D 15/04* (2006.01)

(52) U.S. Cl.
CPC ..... *E04D 15/06* (2013.01); *E04D 5/148* (2013.01); *E04D 2015/042* (2013.01)

(58) Field of Classification Search
CPC .... E04D 5/148; E04D 15/06; E04D 2015/042
See application file for complete search history.

(56) References Cited

U.S. PATENT DOCUMENTS 1,559 A * 4/1840 Williams ..... A23K 20/195 118/75
606,687 A * 7/1898 Williams ..... A01B 29/02 404/131
3,060,077 A * 10/1962 Kauer ..... E04D 15/06 156/322
3,183,139 A * 5/1965 Curtis ..... E04D 15/06 156/575
3,222,241 A * 12/1965 Curtis ..... E04D 15/06 156/575
3,350,256 A * 10/1967 Eckman ..... E01C 23/185 156/497
4,016,323 A * 4/1977 Volovsek ..... B32B 5/18 442/374
4,047,345 A * 9/1977 Aiderman ..... E04D 3/3601 52/404.1
4,093,411 A * 6/1978 Lee ..... B29C 44/1219 264/338

(Continued)

FOREIGN PATENT DOCUMENTS

CN 1727576 A * 2/2006 ..... E01D 19/083
CN 108532857 A * 9/2018

(Continued)

*Primary Examiner* — James M Ference
(74) *Attorney, Agent, or Firm* — Allen, Dyer, Doppelt & Gilchrist, P.A.

(57) ABSTRACT

An installation apparatus for self-adhering roofing material comprises a frame, a roofing material carriage, a press roller, a film take-up roller and a drive connection. A plurality of wheels connected to the frame support the frame for rolling motion over a roof surface. The roofing material carriage is configured to hold a roll of roofing material having a self-adhesive side covered by a release film. The press roller is rotatably mounted to the frame so as to press the self-adhesive side of the roofing material fed thereunder onto the roof surface. The film take-up roller is rotatably mounted to the frame so as to pull the release film from the self-adhesive side of the roofing material and wind the release film thereabout. The drive connection extends between a first end, driven by rotation of the press roller, and a second end, driving rotation of the film take-up roller.

18 Claims, 1 Drawing Sheet

(56) References Cited

U.S. PATENT DOCUMENTS 4,313,780 A * 2/1982 Ford, Jr. ..... E01C 23/185 156/523
4,452,667 A * 6/1984 Chang ..... B65C 11/004 101/288
4,460,433 A * 7/1984 Boyd ..... B29C 65/00 156/574
4,548,016 A * 10/1985 Dubich ..... E04D 15/04 404/107
4,648,935 A * 3/1987 Brown ..... B65H 37/005 156/577
4,711,407 A * 12/1987 Boon ..... B62B 3/10 242/557
4,725,328 A * 2/1988 Arnold ..... B29C 65/106 156/380.9
4,869,044 A * 9/1989 Wald ..... B29C 65/106 52/746.11
5,393,289 A * 2/1995 Green ..... B29C 66/8362 492/13
5,439,540 A * 8/1995 Lippman ..... B32B 37/06 156/322
6,135,934 A * 10/2000 Couch ..... E04D 15/04 15/230.11
6,973,951 B2 * 12/2005 Henegar ..... B29C 66/1122 156/499
7,028,941 B2 * 4/2006 Ibrahim ..... E04D 15/06 156/577
7,763,136 B2 * 7/2010 Richards ..... B65H 35/0033 156/71
7,857,251 B2 * 12/2010 Aveldson ..... E01C 23/03 242/577
8,347,932 B2 * 1/2013 Kalwara ..... E04D 15/04 156/577
8,726,611 B2 * 5/2014 Swei ..... E04D 5/148 52/746.11
9,284,699 B1 * 3/2016 Arnold ..... E01C 23/185
9,970,195 B1 * 5/2018 Vasquez ..... B62B 1/22
2002/0029859 A1 * 3/2002 Weaver ..... E04D 15/06 156/577
2004/0002414 A1 * 1/2004 Barksdale ..... E04D 5/148 492/13
2004/0155087 A1 * 8/2004 Hamlin ..... E04D 15/06 227/110
2004/0188008 A1 * 9/2004 Robison ..... B29C 65/7455 156/251
2006/0065346 A1 * 3/2006 Skoczylas ..... B65H 37/002 156/71
2006/0226168 A1 * 10/2006 Henegar ..... E04D 15/04 221/186
2010/0269981 A1 * 10/2010 Kalwara ..... E04D 15/04 156/577
2013/0186570 A1 * 7/2013 Doniger ..... B65H 37/005 156/577
2013/0228287 A1 * 9/2013 Bessette ..... E04D 15/04 156/499
2014/0064849 A1 * 3/2014 Arnold ..... E01C 23/185 404/75
2016/0376792 A1 * 12/2016 Danielson ..... B32B 43/006 52/741.1
2019/0161979 A1 * 5/2019 Mort ..... B65H 35/008

FOREIGN PATENT DOCUMENTS

DE 3838628 A1 * 5/1990 ..... E04D 15/06
DE 102016121777 A1 * 3/2018 ..... E04D 15/06
EP 0507714 A2 * 10/1992 ..... E01C 23/185
EP 3321445 A1 * 5/2018 ..... E04D 15/06

* cited by examiner

APPARATUS FOR INSTALLATION OF SELF-ADHERING ROOFING MATERIAL

CROSS-REFERENCE TO RELATED APPLICATION

This application claims the benefit of U.S. Provisional Patent Application Ser. No. 62/836,764, filed on Apr. 22, 2019, the contents of which application are herein incorporated by reference in their entirety.

FIELD OF THE INVENTION

The present invention relates to roofing systems, and more particularly, to an apparatus for the installation of self-adhering roofing material.

BACKGROUND OF THE INVENTION

Modified bituminous prepared roofing membrane, also referred to as modified asphalt roofing membrane, is typically manufactured using a reinforcement carrier support sheet made of fabric such as polyester, fiberglass, or a combination of both, and saturating and coating the front and back sides of the carrier with a modified bituminous coating material. Modified bituminous roofing membranes are used in commercial, industrial and residential applications.

In order to provide adhesion and a watertight seal between the roofing membrane and to the roofing surface, a self-adhesive compound that is compatible with the modified bituminous coating layer may be utilized. The factory-applied adhesive layer has sufficient surface tack as well as adequate strength for use in adhering roofing membranes to the roofing surface. The self-adhesive is on one side and is used to secure the roofing membrane to a roofing surface during installation. In particular, the modified bituminous roofing membranes are sold in roll form with a release liner over the self-adhesive to prevent sticking of adjacent sections of the roofing material and to the packaging when the membrane is stored and transported in the form of rolls.

The installation of the modified bituminous roofing membrane is currently a labor intensive and time consuming process. Accordingly, what is needed is an apparatus that reduces installation time of the modified bituminous roofing membrane and using a smaller crew.

SUMMARY OF THE INVENTION

In view of the foregoing, and according to an embodiment of the present invention, an installation apparatus for self-adhering roofing material comprises a frame, a roofing material carriage, a press roller, a film take-up roller and a drive connection. The frame has first and second frame sides, and a plurality of wheels are connected to the frame and support the frame for rolling motion over a roof surface. The roofing material carriage extends between the first and second frame sides and is configured to hold a roll of roofing material having a self-adhesive side covered by a release film.

The press roller is rotatably mounted at first and second press roller ends between the first and second frame sides so as to press the self-adhesive side of the roofing material fed under the press roller from the roofing material carriage onto the roof surface. The film take-up roller is rotatably mounted at first and second film take-up roller ends between the first and second frame sides so as to pull the release film from the self-adhesive side of the roofing material and wind the release film around the film take-up roller.

The drive connection extends between first and second drive ends, the first drive end being driven by rotation of the press roller as the apparatus rolls over the roof surface and the second end driving rotation of the film take-up roller.

According to a method aspect, a method of applying self-adhering roofing material comprises loading a roll of roofing material onto a roofing material carriage of an installation apparatus, the roll of roofing material having a self-adhesive side covered by a release film. The method further comprises feeding the roofing material under a press roller of the installation apparatus such that a weight of the apparatus presses the self-adhesive side onto the roof surface, feeding the release film to a film take-up roller, and moving the apparatus across the roofing surface while driving the film take-up roller from the press roller so that more of the release film continues to feed onto the film take-up roller while more of the self-adhesive side of the roofing material is pressed onto the roof surface.

BRIEF DESCRIPTION OF THE DRAWINGS

For a more complete understanding of the invention, reference is made to the following description and accompanying drawings, in which.

DETAILED DESCRIPTION OF PREFERRED EMBODIMENTS

Figure 1:
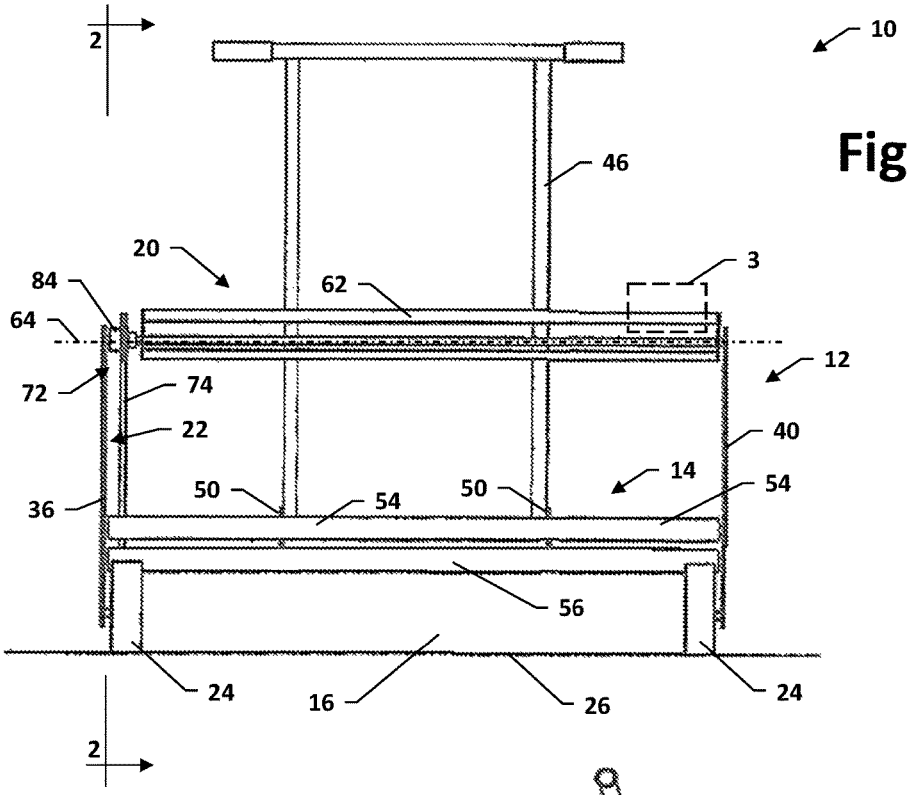
FIG. 1 is a front view of an installation apparatus for self-adhering roofing material, according to an embodiment of the present invention.
Figure 2:
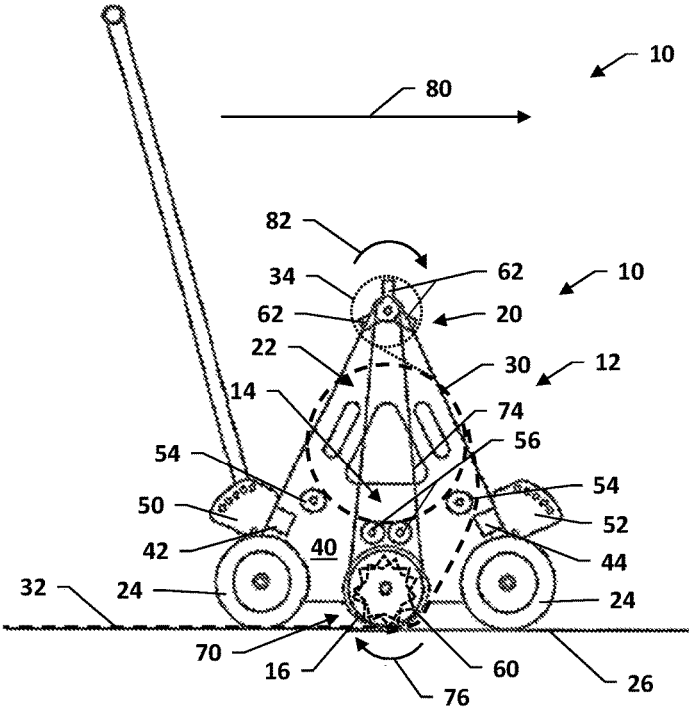
FIG. 2 is a sectional view taken along line 2-2 of FIG. 1.

Referring to FIGS. 1 and 2, according to an embodiment of the present invention, an installation apparatus 10 for self-adhering roofing material includes a frame 12, a roofing material carriage 14, a press roller 16 a film take-up roller 20 and a drive connection 22. The frame 12 is supported by a plurality of wheels 24 for rolling motion over a roof surface 26. The roofing material carriage 14 is configured to hold a roll 30 of roofing material 32 (long broken lines), which has a self-adhesive side (being applied to the roofing surface 26 in FIG. 2) covered while on the roll 30 by a release film 34 (short broken lines). The drive connection 22 allows rotation of the film take-up roller 20 to be driven by rotation of the press roller 16 as the apparatus 10 rolls over the roof surface 26.

In the depicted embodiment are, the frame 12 includes first and second frame sides 36, 40, which are advantageously formed as vertically oriented triangular plates. Respective pairs of the plurality of wheels 24 are connected along respective lower edges of the frame sides 36, 40. Preferably, the frame sides 36, 40 are connected by a pair of struts 42, 44 extending in parallel between the sides 36, 40. A handle 46 is interchangeable connected to either strut 42, 44 of the frame 12 via a respective pair of handle brackets 50, 52. The handle 46 is pivotably connected to either bracket 50, 52, allowing a connection angle of the handle 46 to be varied. (In FIG. 1, the strut 44 and brackets 52 are omitted to allow a better view of the carriage 14.)

The roofing material carriage 14 preferably includes an outer pair of rollers 54 and an inner pair of rollers 56, which are all rotatably connected between the first and second frame sides 36, 40, and free to rotate in response to movement of the roofing material roll 30. The outer pair 54 are mounted outwardly and above the inward pair 56, effectively forming a cradle for the roll 30. The use of the carriage 14 allows the apparatus 10 to readily accommodate rolls having varying widths and diameters, as would frequently be encountered in different real-world roofing installations.

The press roller 16 extends between respective ends rotatably connected to the first and second frame sides 36, 40 along their respective lower edges between the wheels 24 of each pair. The roofing material 32 (with the release film 34 removed and the self-adhesive side down) is fed under the press roller 16, which presses the self-adhesive side onto the roofing surface 26. Advantageously, the weight of the apparatus 10 is set (including the weight of the roller 16, itself) such that the press roller 16 exerts at least 50 lbs. of pressure onto the roofing material 32 being fed thereunder, and most preferably approximately 50-80 lbs. The press roller 16 can also include a heating element 60 to heat the press roller 16 and, by extension, the roofing material 32 to further facilitate adhesion to the roofing surface 26.

Figure 3:
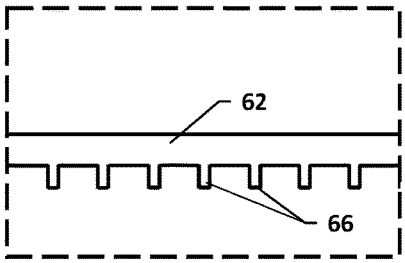
FIG. 3 is a detail view of area 3 of FIG. 1.

The film take-up roller 20 also extends between respective ends rotatably connected to the first and second frame sides 36, 40 near upper apexes thereof and in parallel with the press roller 16 (as well as the carriage roller 54, 56 and the struts 42, 44). The film take-up roller 20 is advantageously formed as a plurality of separate arms 62 (three in the depicted embodiment), which extend longitudinally between the ends of the roller 20 radially outward of its axis 64—similar to the structure of the beaters of a typical hand mixer. Referring also to FIG. 3, a plurality of teeth 66 preferably extend radially inward along the length of each of the plurality of arms 62 to facilitate initial attachment of the release film 34 to the film take-up roller 20.

The drive connection 22 extends between a first end 70, driven by the press roller 16 and a second end 72, which drives the film take-up roller 20 in turn. The drive connection 22 advantageously utilizes a continuous loop 74, in the form of a drive belt or chain, extending between the first and second ends 70, 72 (with respective pulleys or sprockets). Consequently, rotation 76 of the press roller 16 generated by movement of the apparatus 10 while advanced in the direction 80 will drive rotation 82 of the film-take up roller 20.

Preferably, the drive connection 22 includes a disconnectable clutch 84 is located between the ends 70, 72, and most preferably coaxial with the film take-up roller 20 at the second end 72. The clutch 84 allows the film take-up roller 20 to slip relative to the press roller 16, accommodating for an effective increase in diameter of the film take-up roller 20 as more and more release film 34 is rolled thereon. Disconnection of the clutch 84 allows the film take-up roller 20 to be rotated independently of the press roller 16.

In operation, a roll 30 is loaded into the roofing material carriage 14. The release film 34 is peeled back from a leading edge of the roofing material 32 on the roll and fed to the film take-up roller 20 and stuck onto the teeth 66 of the one of the arms 62. The clutch 84 is disconnected so that additional release film 34 can be taken up while a desired length of the roofing material 32 is unrolled to feed under the press roller 16—for example, enough material 32 to extend back to a starting edge of the roofing surface 26. If the press roller 16 is provided with a heating element 60, it is energized to bring the press roller 16 up to a desired temperature.

With a desired length of the roofing material 32 fed under the press roller 16, the clutch 84 is reconnected and the apparatus is advanced in direction 80. This causes rotation 76 of the press roller 16, which simultaneously feeds more roofing material off the roll 30 and drives rotation 82 of the film take-up roller 20. Rotation of the film-take up roller 20 with the press roller 16 ensures that the release film 34 continues to be peeled off the self-adhesive side of the roofing material 32 prior to feeding under the press roller 16.

When the apparatus 10 reaches an opposite edge of the roofing surface 26, the clutch 84 is disconnected again to permit advancement of, and film removal from, enough length of the roofing material 32 to reach the edge. The roofing material 32 is cut so that the apparatus 10 can be moved and the remaining length of material 32 be laid up to the edge. When the apparatus 10 is repositioned to the start of the next section of roofing surface 26 to be covered, the operation is simply repeated as described above.

Excess release film 32 can be removed from the release film roller 20 at any time by cutting the accumulated release film 32 longitudinally between any two of the arms 62, disconnecting the clutch 84, and peeling the accumulated film off. The new leading edge of the release film 32 is then re-engaged to the release film roller 20 as described above.

It will thus be seen that the objects set forth above, among those made apparent from the preceding description, are efficiently attained and, because certain changes may be made in carrying out the above method and in the construction(s) set forth without departing from the spirit and scope of the invention, it is intended that all matter contained in the above description and shown in the accompanying drawings shall be interpreted as illustrative and not in a limiting sense.

What is claimed is:

1. An installation apparatus for self-adhering roofing material, the apparatus comprising:

a frame having first and second frame sides;

a plurality of wheels connected to the frame and supporting the frame for rolling motion over a roof surface;

a roofing material carriage extending between the first and second frame sides and configured to hold a roll of roofing material having a self-adhesive side covered by a release film;

a press roller rotatably mounted at first and second press roller ends between the first and second frame sides so as to press the self-adhesive side of the roofing material fed under the press roller from the roofing material carriage onto the roof surface;

a film take-up roller rotatably mounted at first and second film take-up roller ends between the first and second frame sides so as to pull the release film from the self-adhesive side of the roofing material and wind the release film around the film take-up roller; and a drive connection extending between first and second drive ends, the first drive end being driven by rotation of the press roller as the apparatus rolls over the roof surface and the second end driving rotation of the film take-up roller;

wherein the roofing material carriage includes a plurality of carriage rollers rotatably mounted at respective first and second carriage roller ends between the first and second frame sides so as to cradle the roll of roofing material.

2. The installation apparatus of claim 1, wherein the frame includes a first strut connecting the first and second frame sides and extending in parallel with the roofing material carriage, the press roller and the film take-up roller.

3. The installation apparatus of claim 2, further comprising a handle connected to the frame.

4. The installation apparatus of claim 3, wherein the frame includes a first pair of handle brackets connected to the first strut between the first and second frame sides, the handle being pivotably connected to the first pair of handle brackets.

5. The installation apparatus of claim 4, wherein the frame includes a second strut connecting the first and second frame sides and extending in parallel with the first strut and a second pair of handle brackets connected to the second strut, the handle being removable from the first pair of handle brackets and pivotably connectable to the second pair of handle brackets.

6. The installation apparatus of claim 1, wherein the plurality of wheels includes a first pair of wheels connected along a lower edge of the first frame side with the first press roller end rotatably mounted therebetween and a second pair of wheels connected along an opposing lower edge of the second frame side with the second press roller end rotatably mounted therebetween.

7. The installation apparatus of claim 1, wherein the plurality of carriage rollers include an outer pair and an inner pair, the outer pair being mounted higher on the first and second frame sides than the inner pair.

8. The installation apparatus of claim 1, wherein a weight of the apparatus is set such that the press roller applies at least 50 pounds of pressure to the roofing material fed thereunder.

9. The installation apparatus of claim 8, wherein the weight of the apparatus is set such that the press roller applies 50-80 pounds of pressure to the roofing material fed thereunder.

10. The installation apparatus of claim 1, wherein the press roller is heated.

11. The installation apparatus of claim 1, wherein the film take-up roller includes a plurality of arms extending longitudinally between the first and second film take-up roller ends and radially outward of a film take-up roller axis.

12. The installation apparatus of claim 11, wherein a plurality of teeth extend radially inward from each of the plurality of arms.

13. The installation apparatus of claim 1, wherein the drive connection includes a clutch allowing the film take-up roller to slip relative to the press roller.

14. The installation apparatus of claim 13, wherein the clutch includes a disconnect such that the film take-up roller can be rotated completely independently of the press roller.

15. The installation apparatus of claim 14, wherein the clutch is located at the second drive end.

16. The installation apparatus of claim 1, wherein the drive connection includes at least one of a drive belt and drive chain extending between the first and second drive ends.

17. An installation apparatus for self-adhering roofing material, the apparatus comprising:

a frame having first and second frame sides;

a plurality of wheels connected to the frame and supporting the frame for rolling motion over a roof surface;

a roofing material carriage extending between the first and second frame sides and configured to hold a roll of roofing material having a self-adhesive side covered by a release film;

a press roller rotatably mounted at first and second press roller ends between the first and second frame sides so as to press the self-adhesive side of the roofing material fed under the press roller from the roofing material carriage onto the roof surface;

a film take-up roller rotatably mounted at first and second film take-up roller ends between the first and second frame sides so as to pull the release film from the self-adhesive side of the roofing material and wind the release film around the film take-up roller;

a drive connection extending between first and second drive ends, the first drive end being driven by rotation of the press roller as the apparatus rolls over the roof surface and the second end driving rotation of the film take-up roller; and a handle connected to the frame wherein the frame includes a first strut connecting the first and second frame sides and extending in parallel with the roofing material carriage, the press roller and the film take-up roller;

wherein the frame includes a first pair of handle brackets connected to the first strut between the first and second frame sides, the handle being pivotably connected to the first pair of handle brackets; and wherein the frame includes a second strut connecting the first and second frame sides and extending in parallel with the first strut and a second pair of handle brackets connected to the second strut, the handle being removable from the first pair of handle brackets and pivotably connectable to the second pair of handle brackets.

18. An installation apparatus for self-adhering roofing material, the apparatus comprising:

a frame having first and second frame sides;

a plurality of wheels connected to the frame and supporting the frame for rolling motion over a roof surface;

a roofing material carriage extending between the first and second frame sides and configured to hold a roll of roofing material having a self-adhesive side covered by a release film;

a press roller rotatably mounted at first and second press roller ends between the first and second frame sides so as to press the self-adhesive side of the roofing material fed under the press roller from the roofing material carriage onto the roof surface;

a film take-up roller rotatably mounted at first and second film take-up roller ends between the first and second frame sides so as to pull the release film from the self-adhesive side of the roofing material and wind the release film around the film take-up roller; and a drive connection extending between first and second drive ends, the first drive end being driven by rotation of the press roller as the apparatus rolls over the roof surface and the second end driving rotation of the film take-up roller;

wherein the film take-up roller includes a plurality of arms extending longitudinally between the first and second film take-up roller ends and radially outward of a film take-up roller axis; and wherein a plurality of teeth extend radially inward from each of the plurality of arms.

* * * * *